US012030596B2

(12) United States Patent
Teshima et al.

(10) Patent No.: US 12,030,596 B2
(45) Date of Patent: Jul. 9, 2024

(54) FLOATING OCEANIC DEBRIS COLLECTION DEVICE AND COMPLEX FLOATING OCEANIC DEBRIS COLLECTION DEVICE

(71) Applicant: Teshima Tusho Corporation, Kochi (JP)

(72) Inventors: Hiromitsu Teshima, Kochi (JP); Mari Teshima, Kochi (JP)

(73) Assignee: Teshima Tusho Corporation (JP)

( * ) Notice: Subject to any disclaimer, the term of this patent is extended or adjusted under 35 U.S.C. 154(b) by 476 days.

(21) Appl. No.: 17/415,719

(22) PCT Filed: Dec. 10, 2019

(86) PCT No.: PCT/JP2019/048317
§ 371 (c)(1),
(2) Date: Feb. 2, 2022

(87) PCT Pub. No.: WO2020/129755
PCT Pub. Date: Jun. 25, 2020

(65) Prior Publication Data

US 2022/0161902 A1 May 26, 2022

(30) Foreign Application Priority Data

Dec. 21, 2018 (JP) ..... 2018-240218

(51) Int. Cl.
*B63B 35/32* (2006.01)
*E02B 15/00* (2006.01)

(52) U.S. Cl.
CPC ..... *B63B 35/32* (2013.01); *E02B 15/00* (2013.01)

(58) Field of Classification Search
CPC ..... B63B 35/32; E02B 15/00; E02B 15/045; E02B 15/106
(Continued)

(56) References Cited

U.S. PATENT DOCUMENTS 4,264,444 A * 4/1981 Bronnec ..... E02B 15/046 210/923

FOREIGN PATENT DOCUMENTS

EP 0006823 B1 * 10/1981 ..... E02B 15/104
JP 1993-35594 5/1993
(Continued)

OTHER PUBLICATIONS

Translation of Manabe (JP2001129589A) (Year: 2001).*
(Continued)

*Primary Examiner* — Ekandra S. Miller-Cruz
(74) *Attorney, Agent, or Firm* — Fishman Stewart PLLC

(57) ABSTRACT

A floating oceanic debris collection device may include a circular base, a debris collection unit, and a debris storage unit. The debris collection unit may include a blade erected on an upper surface of the base and an arm extending in an outward direction to a rotation direction side. The debris storage unit may include an annular inner peripheral float installed on a lower surface of the base, an inlet penetrating a peripheral surface of the inner peripheral float, and an outlet penetrating the upper surface of the base. An entirety of the base may be configured to rotate via receiving wind on the sea with the blade. The arm may be configured to scrap debris floating on a sea surface inward. The inlet may be configured to introduce the debris to an inside. The outlet may be configured to facilitate removal of the debris from the debris storage unit.

16 Claims, 7 Drawing Sheets

(58) Field of Classification Search
USPC ..... 210/170.11
See application file for complete search history.

(56) References Cited

FOREIGN PATENT DOCUMENTS

| | | | |
|---|---|---|---|
| JP | 1998-95393 | | 4/1998 |
| JP | 2008-138441 | A | 6/2008 |
| JP | 2008-150816 | A | 7/2008 |
| JP | 2010-77691 | A | 4/2010 |
| JP | 2018-17064 | A | 2/2018 |

OTHER PUBLICATIONS

English abstract for JP-2018-17064.
English abstract for JP-2008-138441.
Engilsh abstract for JP-2008-150816.
English abstract for JP-2010-77691.
English abstract for JP-1993-35594.
English abstract for JP-1998-95393.

* cited by examiner

FLOATING OCEANIC DEBRIS COLLECTION DEVICE AND COMPLEX FLOATING OCEANIC DEBRIS COLLECTION DEVICE

CROSS REFERENCE TO RELATED APPLICATIONS

This application claims priority to International Patent Application No. PCT/JP2019/048317, filed on Dec. 10, 2019, and Japanese Patent Application No. JP 2018-240218, filed on Dec. 21, 2018, the contents of both of which are hereby incorporated by reference in their entirety.

TECHNICAL FIELD

The present invention relates to a floating oceanic debris collection device capable of automatically collecting debris floating on a sea surface, and a complex floating oceanic debris collection device including a plurality of the devices.

BACKGROUND

In recent years, an increase in debris flowing into the sea has become an international problem, and in particular, plastic debris is not spontaneously decomposed and continues to drift in the sea unless the plastic debris is collected. As a result, it is known that there are risks that the plastic itself and harmful substances attached to the plastic are taken into animals such as plankton and fish as small crushed microplastics and normal life activities are inhibited.

Thus, a mechanism for collecting the plastic debris and other debris flowed into the sea has been demanded as an urgent problem.

As the mechanism for collecting the debris on the sea, for example, self-propelled debris collection devices using a single-body and double-body hull disclosed in JP 1993-35594 U (Patent Literature 1) and JP 1998-95393 A (Patent Literature 2) can be used.

Since these self-propelled debris collection devices of the related art can autonomously collect debris floating on the sea by causing the hull to self-propel, it is efficient to collect debris at some specified locations such as ponds and lakes.

However, in a situation where debris needs to be collected over a wide range such as the sea, it is very inefficient to use a self-propelled debris collection device, and the amount of debris that can be collected is also very limited.

For example, an automatic debris collection device disclosed in JP 2018-17064 A (Patent Literature 3) is also known. The present invention has been made to solve disadvantages of the above self-propelled debris collection device of the related art, and is a device that includes a container including a net, a float for floating the container, and a pumping mechanism for pumping out water in the container.

However, the automatic debris collection device of the related art collects the debris by using the fact that the water flows into the container due to a height difference from a water surface around the container by pumping out the water in the container and the debris on the sea flows into the container. Thus, it is difficult to say that the automatic debris collection device of the related art stably operates even on a water surface with severe movement such as a tide or a wave on the sea although the automatic debris collection device of the related art seems to stably operate on a gentle water surface such as a pond, a lake, or a water storage facility. When the scale of the device is to be increased to be suitable for use on the sea, since a pumping mechanism having performance corresponding the scale of the device is required, it is not realistic.

CITATION LIST

Patent Literature

Patent Literature 1: JP 1993-35594 U
Patent Literature 2: JP 1998-95393 A
Patent Literature 3: JP 2018-17064 A

SUMMARY

An object of the present invention is to provide a floating oceanic debris collection device that can automatically collect debris, is suitable for use on a sea, and can be used without maintenance for a long period.

Solution to Problem

A floating oceanic debris collection device which is the present invention made in order to solve the above problems is a floating oceanic debris collection device that has a circular shape in plan view, is installed on a sea, and collects debris floating on a sea surface. A base having a circular shape is divided into an inner peripheral side and an outer peripheral side, a debris collection unit is provided on the outer peripheral side of the base, and a debris storage unit is provided on the inner peripheral side of the base, the debris collection unit includes a blade that is erected on an upper surface of the base and rotates the base by receiving wind on the sea, and an arm of which a proximal end is fixed to the base and a distal end extends to a rotation direction side which is an outward direction, the debris storage unit includes an inner peripheral float installed in an annular shape on a lower surface of the base, an inlet formed to penetrate on a peripheral surface of the inner peripheral float, and an outlet formed to penetrate on an upper surface of the base, and the entire base is able to rotate by receiving the wind on the sea by the blade of the debris collection unit, scrap the debris floating on the sea surface inward by the arm, introduce the debris to an inside from the inlet formed in the debris storage unit, and take in the debris from the outlet formed in a top surface of the debris storage unit.

When a guide plate protruding from the peripheral surface of the debris storage unit and extending in the same direction as a rotation direction of the debris collection unit is formed at a rear end edge in the inlet, it is possible to more reliably collect the debris floating on the sea surface.

When two attachment holes are formed in the arm, one round hole and one long hole are formed in the base, the arm is pivotally supported by the base by inserting two shafts into the attachment holes of the arm and the round hole and the long hole of the base, the arm is swingably supported in a predetermined range with the shaft inserted in the round hole by enabling the movement of the shaft in the long hole as a support point, and a position of the arm in an up-down direction is able to be adjusted by providing fasteners capable of adjusting a position in an up-down direction in at least one end of the shaft, it is possible to collect the debris floating on the sea surface in a wider range by the moving arm.

When the blade is made of a flexible sheet having a convex quadrangular shape in plan view and having a shape of which lengths of two sides continuous to a predetermined on side are different, and is formed in a semi-dorm shape of which a long side is higher than a short side by being fixed to the base in a state of being bent such that both ends of the long side of the two sides approach, since a three-dimensional blade can be made of one sheet without molding in advance, it is reasonable and economical.

When the base is a donut type having a cavity in a center, a central float is provided in the cavity, and a position of the entire device is able to be fixed by attaching an anchor to the central float, it is possible to position the floating oceanic debris collection device with a simple configuration.

When a complex floating oceanic debris collection device is installed on a sea includes a plurality of housing units having a shape hollowed out in a circular shape in plan view and the above floating oceanic debris collection device is housed in each housing unit, it is possible to easily realize a larger floating oceanic debris collection device.

Advantageous Effects of Invention

According to the present invention, it is possible to provide a floating oceanic debris collection device that can automatically collect the debris over the wide range regardless of a type of the debris floating on the sea and does not require maintenance since the floating oceanic debris collection device is driven only by wind on the sea without using an electric power or other artificial power.

It is possible to collect the debris on the sea on a larger scale by providing the complex floating oceanic debris collection device in which the plurality of the floating oceanic debris collection devices is housed, and it is also possible to effectively use the space provided in the inside for various purposes such as residential facilities, environmental improvement facilities, observation facilities, power generation facilities, and the like of the population floating island.

DETAILED DESCRIPTION

Figure 1:
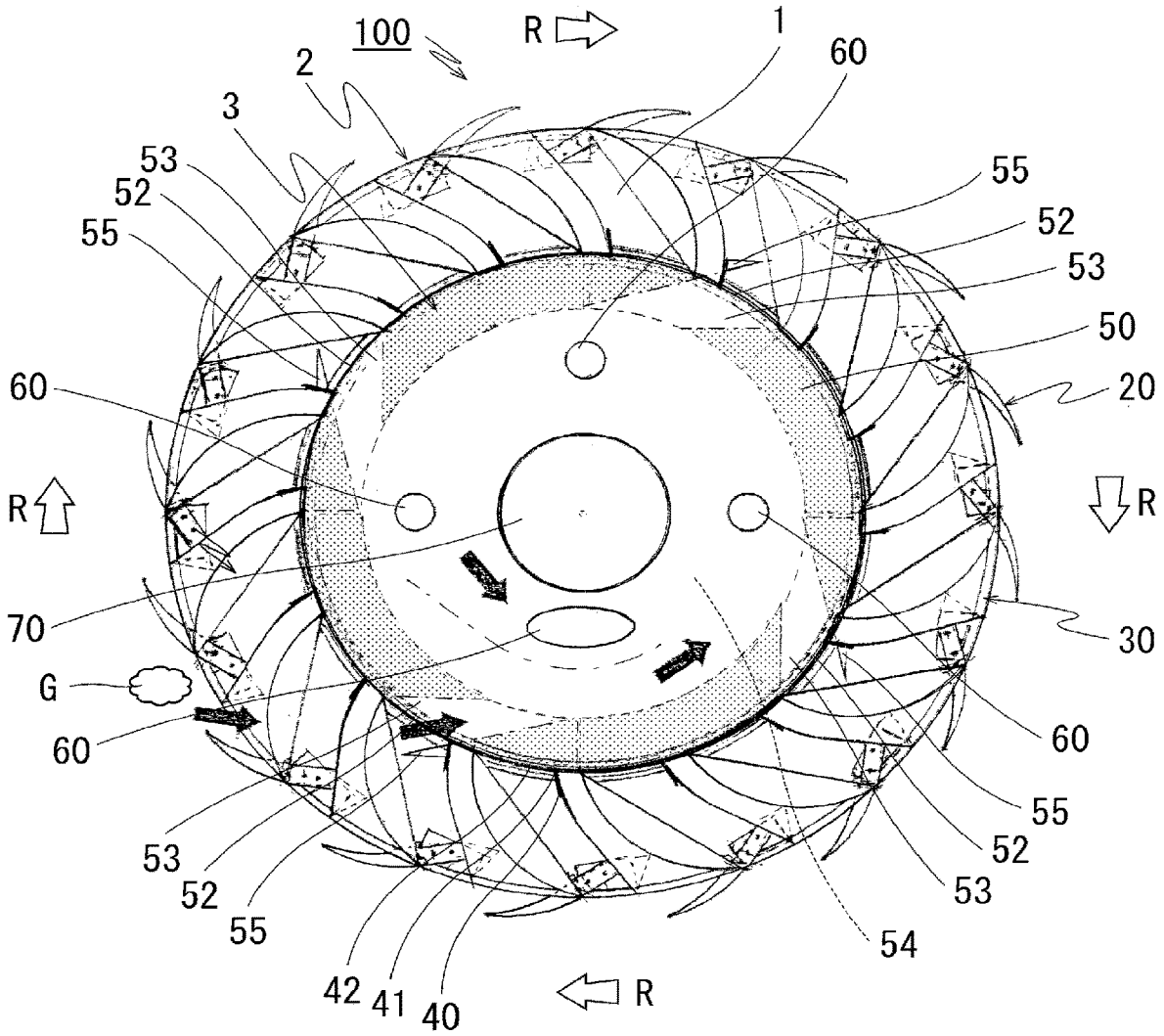
FIG. 1 is a plan view illustrating a preferred embodiment of the present invention.
Figure 2:
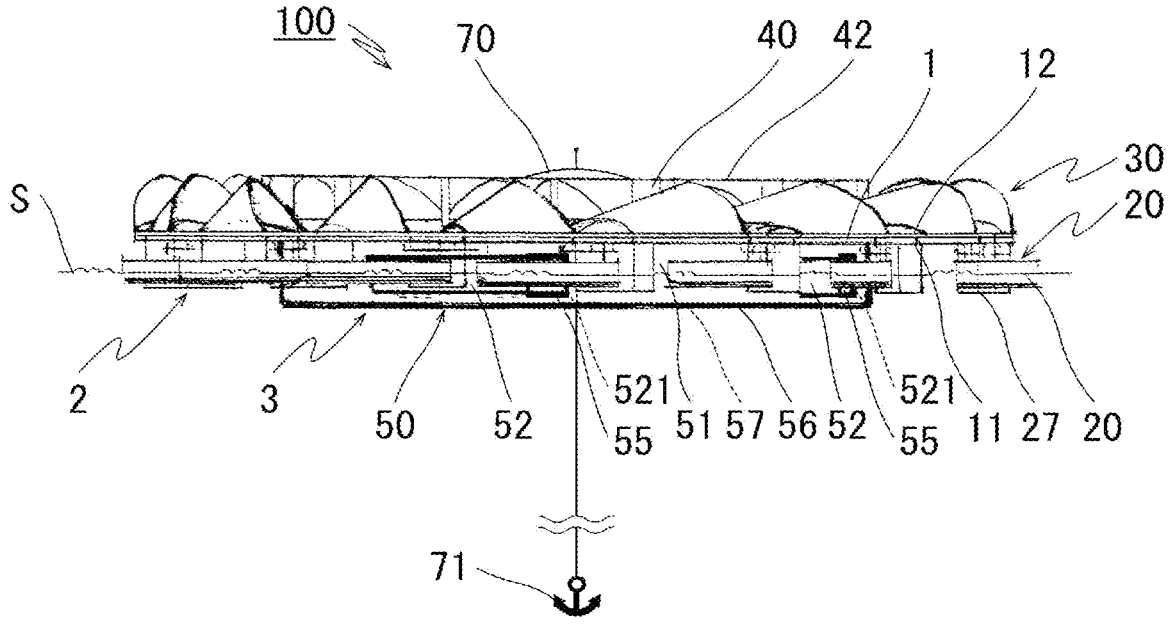
FIG. 2 is a side view of the embodiment illustrated in FIG. 1.
Figure 3:
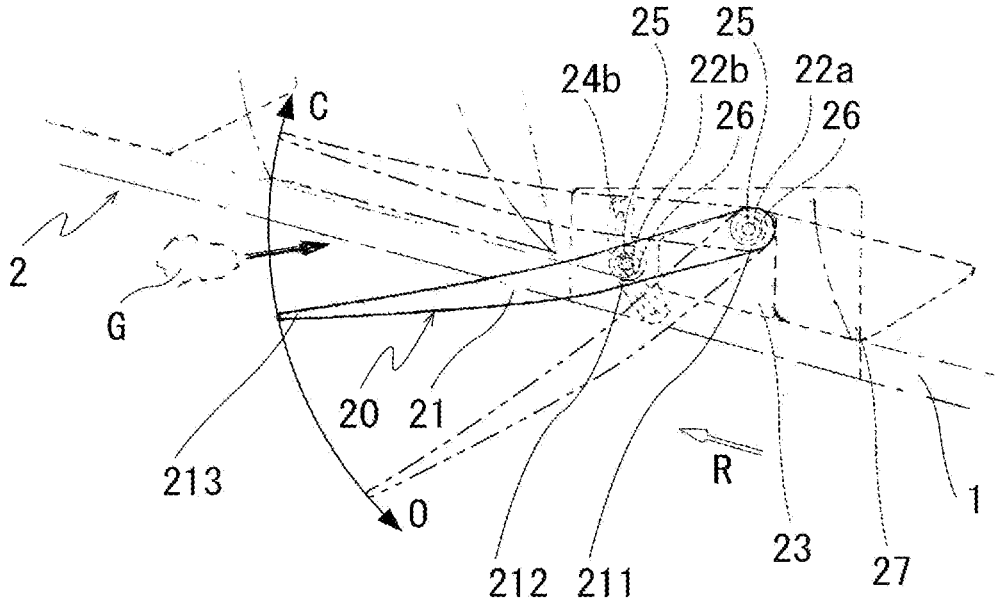
FIG. 3 is a partial sectional view illustrating an arm in the embodiment illustrated in FIG. 1.
Figure 4:
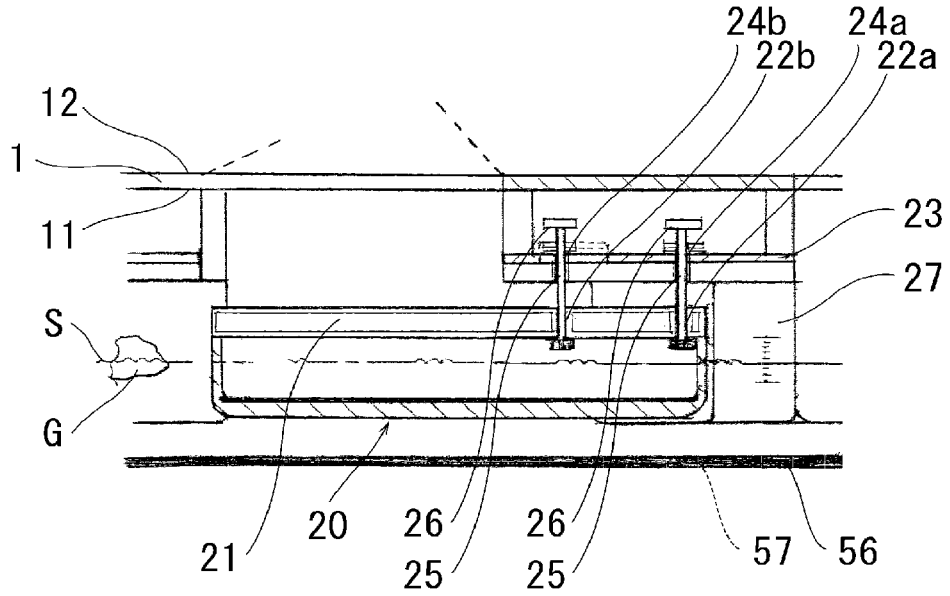
FIG. 4 is a partial plan view illustrating the arm in the embodiment illustrated in FIG. 1.

Hereinafter, a preferred embodiment of the present invention will be described in detail with reference to the drawings.

FIGS. 1 to 6 are diagrams illustrating the preferred embodiment of the present invention, and in a floating oceanic debris collection device 100, a circular plate-shaped donut type base 1 having a cavity at a center in plan view is divided into an inner peripheral side and an outer peripheral side, a debris collection unit 2 is provided on the outer peripheral side of the base 1, and a debris storage unit 3 is provided on the inner peripheral side of the base 1. A reference sign S represents a sea surface.

The debris collection unit 2 includes 16 arms 20 attached to a lower surface 11 of the base 1 at equal intervals and having distal ends extending to a rotation direction side which is an outward direction, and 16 blades 30 erected at equal intervals on an upper surface 12 of the base 1.

The arm 20 includes an arm member 21 including two attachment holes 22*a* and 22*b*, an arm attachment member 23 in which one round hole 24*a* and one long hole 24*b* are formed, two shafts 25 inserted into the attachment holes 22*a* and 22*b* of the arm member 21 and the round hole 24*a* and the long hole 24*b* of the arm attachment member 23 and attached so as not to fall off by position-adjustable fasteners 26*a* and 26*b* provided at both ends, and an outer peripheral float 27 provided integrally with the arm attachment member 23 and giving buoyancy to the base 1.

In the arm 20, the shaft 25 inserted into the long hole 24*b* moves in the long hole 24*b*, and thus, the arm member 21 can swing with the shaft 25 inserted into the round hole 24*b* as a support point. An effective length of the shaft 25 is changed by vertically adjusting a position of the fastener 26 of the shaft 25, and thus, a position of the arm member 21 in an up-down direction can be adjusted.

In the present embodiment, the attachment hole 22*a* is formed at a proximal end position 211 of the arm member 21, and the attachment hole 22*b* is formed at an intermediate position 212 slightly closer to a distal end 213 than the proximal end position 211. The arm member 21 and the arm attachment member 23 are integrated by inserting and fixing the shafts 25 by the fasteners 26 in a state in which the attachment hole 22*a* of the arm member 21 and the round hole 24*a* of the arm attachment member 23 are communicatively connected with each other and the attachment hole 22*b* of the arm member 21 and the long hole 24*b* of the arm attachment member 23 are communicatively connected with each other (see FIG. 3).

At this time, in the arm member 21, the shaft 25 inserted at the intermediate position 212 moves in the long hole 24*b* with the shaft 25 inserted at the proximal end position 211 as the support point, and thus, the distal end 213 can swing in an opening direction O and a closing direction C. Accordingly, debris G floating in a wider range can be guided to and collected in the inside of the debris collection unit 2 (see FIG. 4).

It is more preferable that the distal end 213 of the arm member 21 has flexibility.

The outer peripheral float 27 serves to adjust such that a rotation speed of the entire base 1 becomes an appropriate rotation speed by giving buoyancy to the base 1 and receiving resistance of water when the base 1 rotates.

The blade 30 is made of a flexible sheet 31 having a convex quadrangular shape in plan view and having a shape in which lengths of a long side 33 and a short side 34 continuous to a predetermined side 32 are different.

Folded portions 36 and 37 having predetermined widths are formed on one side 32 of the sheet 31 and a facing side 35, respectively.

Figure 5:
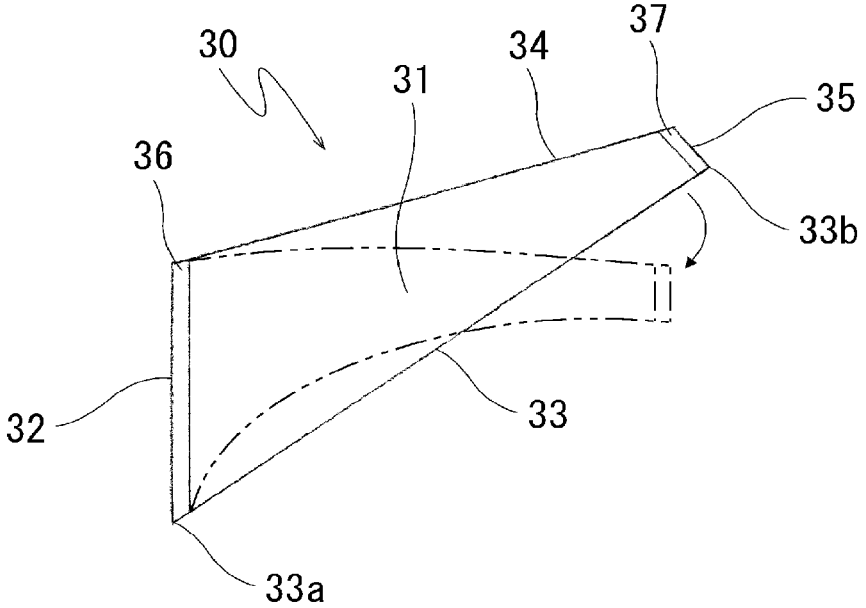
FIG. 5 is a schematic view illustrating a sheet forming a blade in the embodiment illustrated in FIG. 1.
Figure 6:
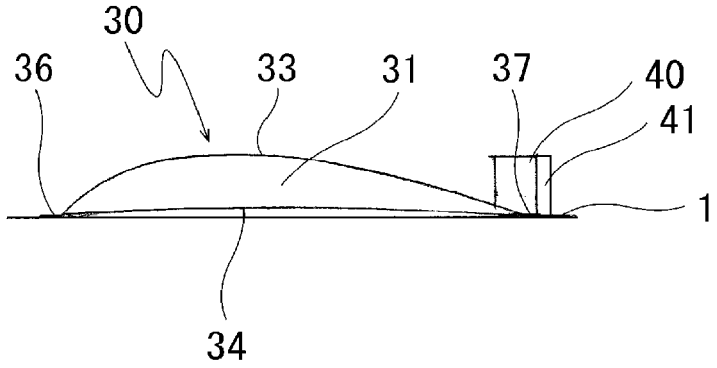
FIG. 6 is a schematic view illustrating the blade in the embodiment illustrated in FIG. 1.

The blade 30 is formed in a half-dome shape of which the long side 33 has a height higher than that of the short side 34 by folding the folded portions 36 and 37 outward in a state in which both ends 33*a* and 33*b* of the long side 33 are bent so as to approach each other and fixing the folded portions 36 and 37 to the base 1 in a state of being substantially parallel to each other (see FIG. 5).

As described above, the rotation direction of the entire base 1 can be limited to a desired direction by forming the blades 30 in the semi-dome shapes and installing all the blades 30 in a constant orientation.

In the present embodiment, the folded portions 36 and 37 are folded outward, but it is a matter of course that the folded portions may be folded inward.

A reference sign 40 is a vertical blade, is attached to a framework including 16 pillars 41 vertically erected from the base 1 and a circular reinforcing frame 42 connecting the pillars 41, and is integrally fixed to the pillars 41.

The debris storage unit 3 includes an annular inner peripheral float 50 fixed to the lower surface 11 of the base 1, inlets 52 formed to penetrate through a plurality of positions on a peripheral surface 51 of the inner peripheral float 50, outlets 60 formed to penetrate through the upper surface 12 of the base 1, and a substantially columnar central float 70 disposed in a central cavity of the base 1.

The inner peripheral float 50 has an annular shape as a whole, and four inlets 52 formed to penetrate toward the center are provided on the peripheral surface 51 thereof.

A space between each of the inlets 52 formed to penetrate and the inside of the inner peripheral float 50 is a passage 53 that is communicatively with a space 54 inside the inner peripheral float 50 and between the base 1 and the sea surface S.

A guide plate 55 protruding from the peripheral surface 51 of the inner peripheral float 50 and extending in the same direction as a rotation direction R of the debris collection unit 2 is attached to a rear end edge 521 of each inlet 52 with respect to the rotation direction R.

At this time, since a net 57 covering the entire lower surface 56 is attached to the inner peripheral float 50, even though the debris G collected in the space 54 sinks, there is no concern that the debris G flows out to the sea again.

An openable and closable lid is attached to each of the plurality of outlets 60 formed on the upper surface 12 of the base 1. The lid is closed in normal times, and the lid is opened when the collected debris G is collected in the space 54.

The central float 70 is disposed in a cavity formed at the center of the base 1, and can fix a position of the entire floating oceanic debris collection device 100 on the sea by attaching an anchor 71 to the central float 70.

In the floating oceanic debris collection device 100 of the present invention having the above configuration, the entire base 1 can rotate in the R direction indicated in FIG. 1 by receiving the wind from the sea by the blades 30 of the debris collection unit 2, can scrap the debris G floating on the sea surface S inward by the arms 20, cam introduce and store the debris G in the space 54 in the inner peripheral float 50 from the inlets 52 formed on the peripheral surface 51 of the inner peripheral float 50 of the debris storage unit 3, and can take out the debris G from the plurality of outlets 60 formed on the upper surface 12 of the base 1 to be communicatively connected with the space 54.

At this time, since the guide plate 55 is attached to each inlet 52, the debris G scraped into the debris collection unit 2 can be smoothly introduced into the inlets 52 along the guide plate 55.

In the present embodiment, since the debris collection unit 2 and the debris storage unit 3 use the common base 1, the debris collection unit 2 and the debris storage unit 3 rotate in synchronization with each other. However, for example, the debris collection unit and the debris storage unit may be independent separate bodies, and may rotate independently (not illustrated).

Figure 7:
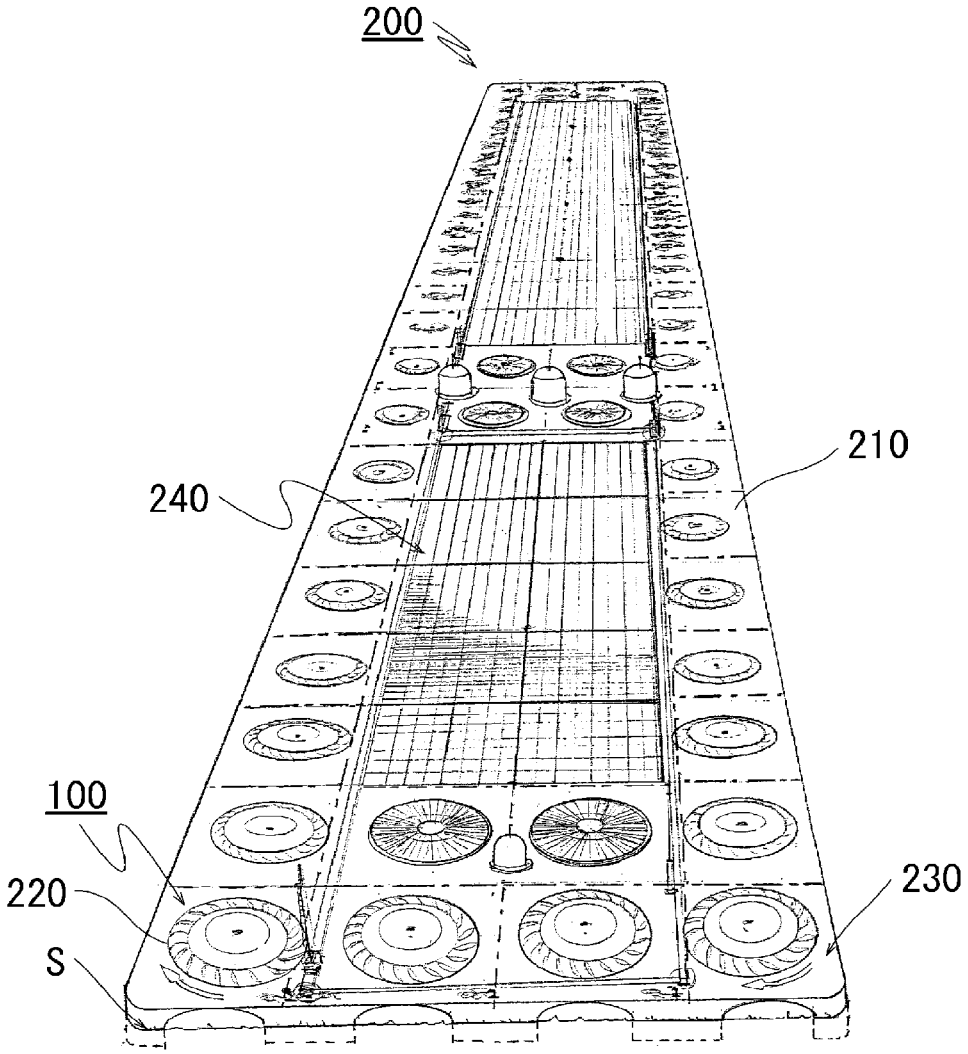
FIG. 7 is a schematic perspective view illustrating an embodiment of a complex floating oceanic debris collection device according to the present invention.

FIG. 7 is a view illustrating a complex floating oceanic debris collection device 200 including a plurality of the floating oceanic debris collection devices 100 illustrated in FIG. 1. In the present embodiment, the floating oceanic debris collection devices 100 are housed in a plurality of housing units 220 of a float body 210 having the housing units 220 hollowed out in a circular shape in plan view on an outer periphery 230.

According to the complex floating oceanic debris collection device 200 of the present embodiment, it is possible to collect the debris on the sea over a wider range than the single floating oceanic debris collection device 100, and it is possible to effectively use the space provided in an inside 240 for various purposes such as residential facilities, environmental improvement facilities, observation facilities, power generation facilities, and the like of a population floating island.

Figure 8:
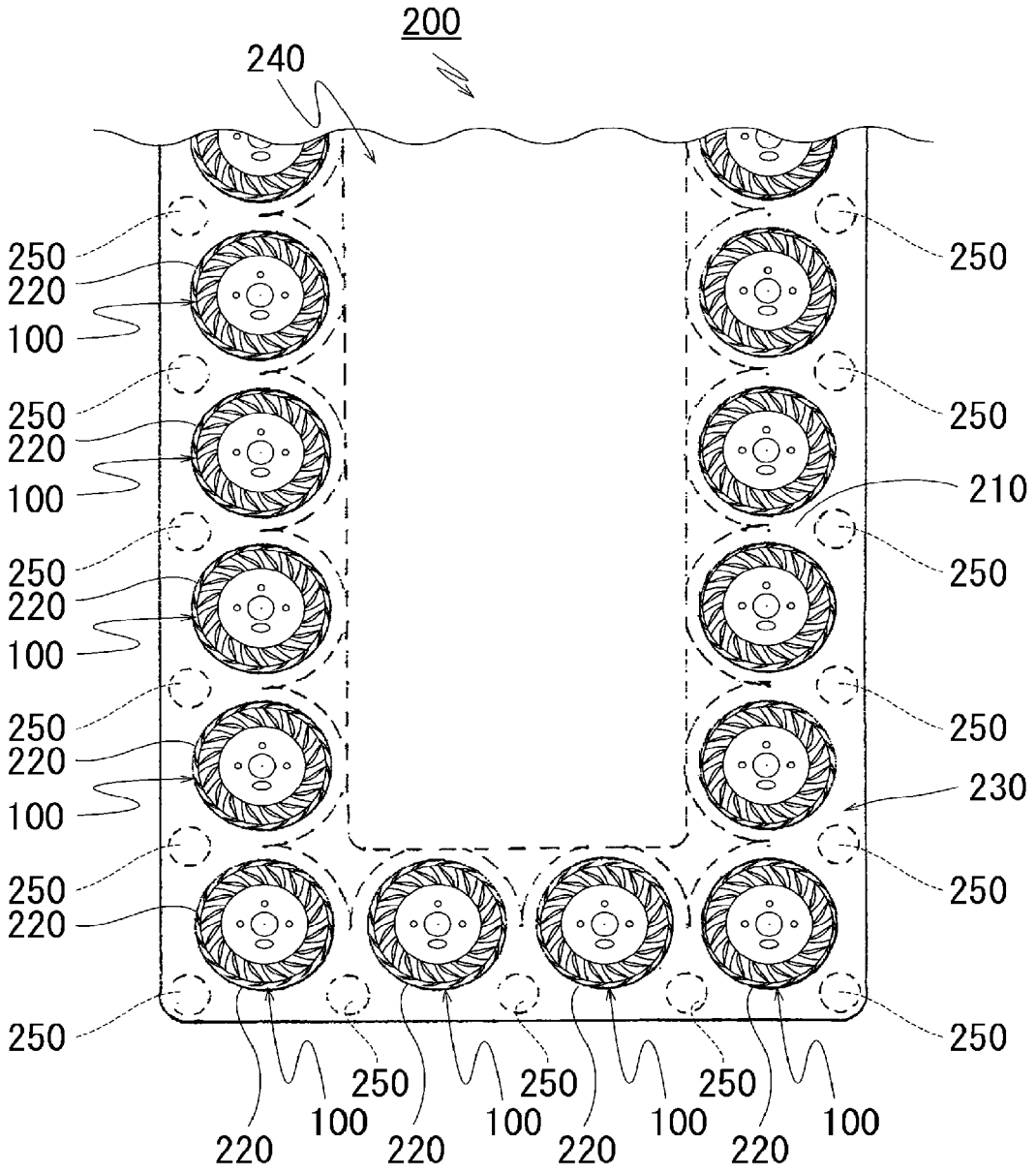
FIG. 8 is a schematic plan view of the embodiment illustrated in FIG. 7.
Figure 9:
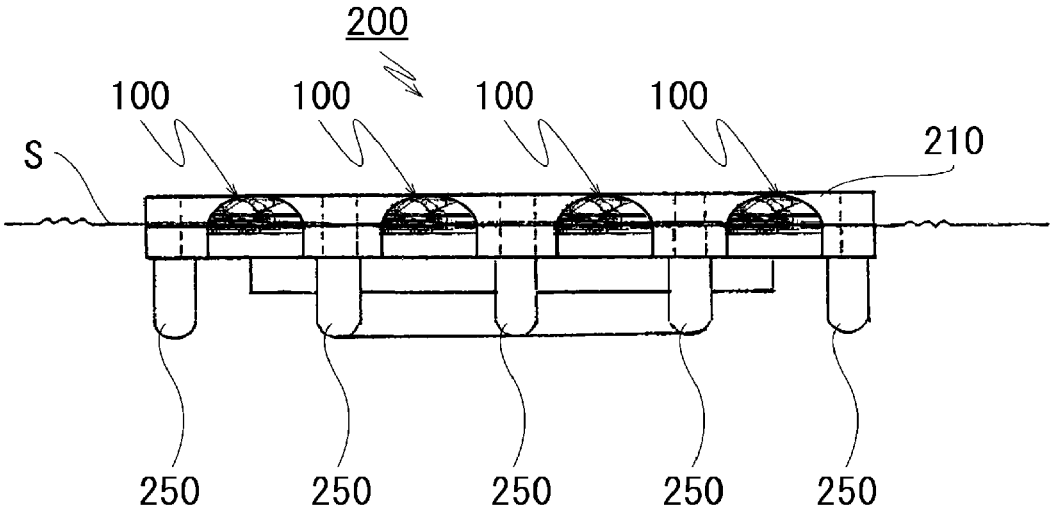
FIG. 9 is a schematic front view of the embodiment illustrated in FIG. 7.

Although the float body 210 floats on the sea by the buoyancy of a plurality of integrally fixed pillar floats 250, for example, the float body 210 itself may be made of a material exhibiting buoyancy, and the float body can be floated on the sea by any other method (See FIGS. 8 and 9).

Figure 10:
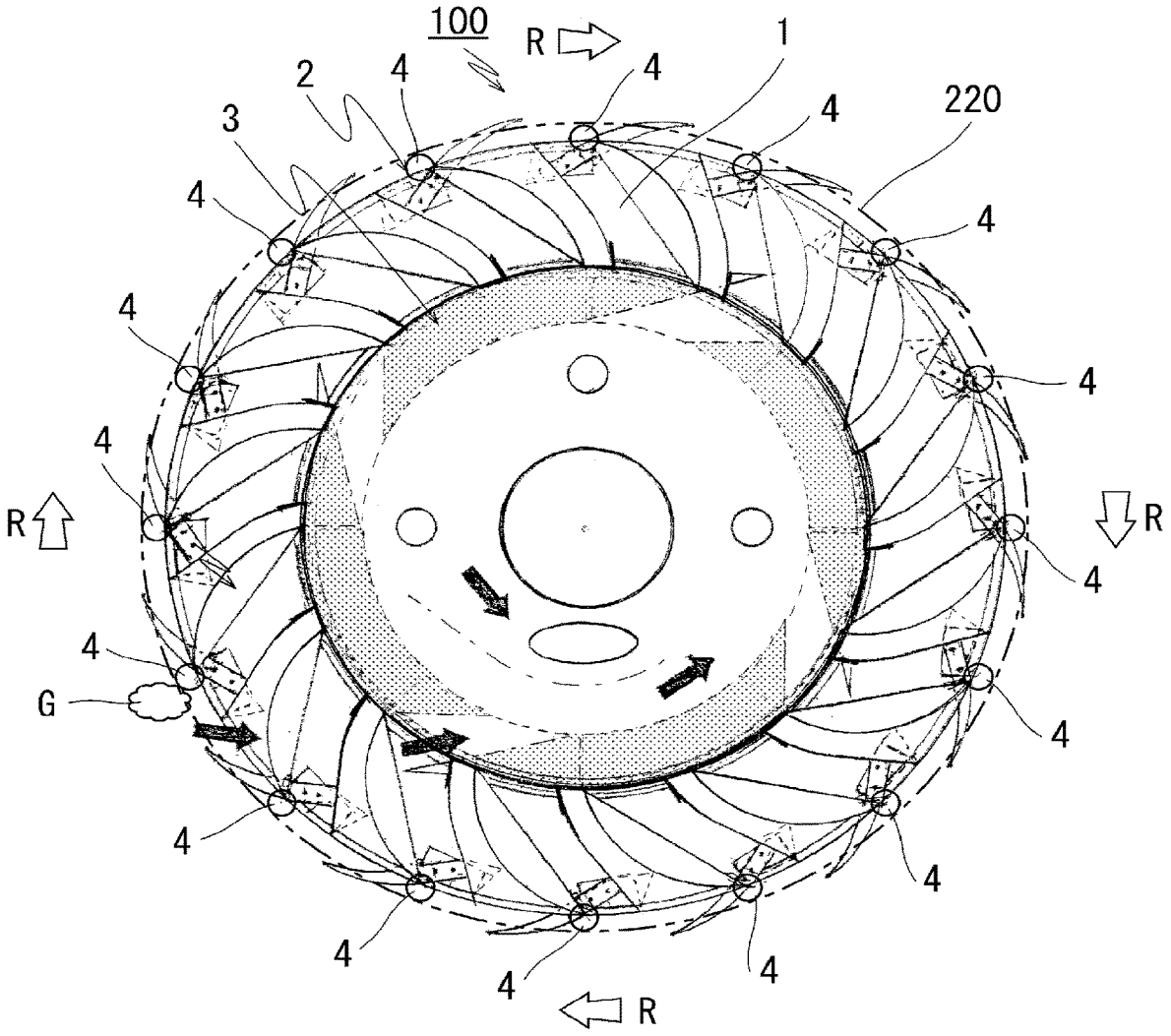
FIG. 10 is a schematic view illustrating a floating oceanic debris collection device suitable for the embodiment illustrated in FIG. 7.

A plurality of rollers 4 is attached to the outer periphery of the base 1 of the floating oceanic debris collection device 100, and the rollers 4 come into contact with an inner periphery of the housing unit 220 of the float body 210. Accordingly, since the base 1 of the floating oceanic debris collection device 100 does not directly hit the housing unit, the base 1 of the floating oceanic debris collection device 100 can be smoothly rotated, and the occurrence of a failure due to collision can be prevented (see FIG. 10).

According to the present invention, it is possible to provide a floating oceanic debris collection device that can automatically collect the debris over the wide range regardless of a type of the debris floating on the sea and does not require maintenance since the floating oceanic debris collection device is driven only by wind on the sea without using an electric power or other artificial power.

It is possible to collect the debris on the sea on a larger scale by providing the complex floating oceanic debris collection device in which the plurality of the floating oceanic debris collection devices is housed, and it is also possible to effectively use the space provided in the inside for various purposes such as residential facilities, environmental improvement facilities, observation facilities, power generation facilities, and the like of the population floating island.

REFERENCE SIGNS LIST

1 base
2 debris collection unit
3 debris storage unit
4 roller
11 lower surface
12 upper surface
20 arm
21 arm member
22*a*, 22*b* attachment hole
23 arm attachment member
24*a* round hole
24*b* long hole

25 shaft
26 fasteners
27 outer peripheral float
211 proximal end position
212 intermediate position
213 distal end
30 blade
31 sheet
32 one side
33 long side
34 short side
35 facing side
36, 37 folded portion
40 vertical blade
41 pillar
42 reinforcing frame
50 inner peripheral float
51 peripheral surface
52 inlet
53 passage
54 space
55 guide plate
56 lower surface
57 net
60 outlet
70 central float
71 anchor
100 floating oceanic debris collection device
200 complex floating oceanic debris collection device
210 float body
220 housing unit
230 outer periphery
240 inside
250 pillar float
G debris
S sea surface
R rotation direction
C closing direction
O opening direction

The invention claimed is:

1. A floating oceanic debris collection device, comprising:
a base having a circular shape, the base divided into an inner peripheral side and an outer peripheral side;
a debris collection unit disposed on the outer peripheral side of the base; and
a debris storage unit disposed on the inner peripheral side of the base;
the debris collection unit including:
a blade that is erected on an upper surface of the base and that is configured to rotate the base via receiving wind on a sea; and
an arm having a proximal end that is fixed to the base and a distal end that extends in a rotation direction of the debris collection unit;
the debris storage unit including:
an inner peripheral float installed in an annular shape on a lower surface of the base;
an inlet formed to penetrate a peripheral surface of the inner peripheral float; and
an outlet formed to penetrate the upper surface of the base;
wherein, via receiving the wind on the sea with the blade of the debris collection unit, an entirety of the base is configured to rotate, scrap debris floating on a sea surface of the sea inward via the arm, and introduce the debris to an inside via the inlet formed in the debris storage unit; and
wherein the debris is removable via the outlet.

2. The floating oceanic debris collection device according to claim 1, further comprising a guide plate protruding from a peripheral surface of the debris storage unit and extending in the rotation direction of the debris collection unit, wherein the guide plate is disposed at a rear end edge of the inlet.

3. The floating oceanic debris collection device according to claim 1, wherein:
two attachment holes are disposed in the arm, the two attachment holes including a first attachment hole and a second attachment hole;
a round hole and a long hole are disposed in the base;
the arm is pivotally supported by the base via two shafts, the two shafts including (i) a first shaft inserted into the first attachment hole of the arm and the round hole of the base and (ii) a second shaft inserted into the second attachment hole of the arm and the long hole of the base;
the arm is swingably supported with the first shaft as a support point that enables movement of the second shaft in the long hole; and
at least one end of at least one of the two shafts includes a fastener via which a position of the arm is adjustable in an up-down direction.

4. The floating oceanic debris collection device according to claim 1, wherein:
the blade is structured as a flexible sheet having a convex quadrangular shape in a plan view;
the blade has two sides continuous to a predetermined side, the two sides including a long side and a short side that are different lengths; and
the blade has a semi-dome shape and is fixed to the base in a state of being bent such that both ends of the long side approach each other and the long side is higher than the short side.

5. The floating oceanic debris collection device according to claim 1, wherein:
the base is a donut shape having a cavity in a center;
a central float is disposed in the cavity; and
a position of the floating oceanic debris collection device is fixable via attaching an anchor to the central float.

6. A floating oceanic debris collection device, comprising:
a float body including a plurality of housing units hollowed out in a circular shape in a plan view; and
a plurality of floating oceanic debris collection devices that are each housed in a respective housing unit of the plurality of housing units, each of the plurality of floating oceanic debris collection devices including:
a base having a circular shape, the base divided into an inner peripheral side and an outer peripheral side;
a debris collection unit disposed on the outer peripheral side of the base, the debris collection unit including:
a blade that is erected on an upper surface of the base and that is configured to rotate the base via receiving wind on a sea; and
an arm having a proximal end that is fixed to the base and a distal end that extends in a rotation direction of the debris collection unit;
a debris storage unit disposed on the inner peripheral side of the base, the debris storage unit including:
an inner peripheral float installed in an annular shape on a lower surface of the base;
an inlet formed to penetrate a peripheral surface of the inner peripheral float; and an outlet formed to penetrate the upper surface of the base;

wherein, via receiving the wind on the sea with the blade of the debris collection unit, an entirety of the base is configured to rotate, scrap debris floating on a sea surface of the sea inward via the arm, and introduce the debris to an inside via the inlet formed in the debris storage unit; and wherein the debris is removable via the outlet.

7. The floating oceanic debris collection device according to claim 6, wherein each of the plurality of floating oceanic debris collection devices further include a guide plate protruding from a peripheral surface of the debris storage unit and extending in the rotation direction of the debris collection unit, and wherein the guide plate is disposed at a rear end edge of the inlet.

8. The floating oceanic debris collection device according to claim 6, wherein:

two attachment holes are disposed in the arm, the two attachment holes including a first attachment hole and a second attachment hole;

a round hole and a long hole are disposed in the base;

the arm is pivotally supported by the base via two shafts, the two shafts including (i) a first shaft inserted into the first attachment hole of the arm and the round hole of the base and (ii) a second shaft inserted into the second attachment hole of the arm and the long hole of the base;

the arm is swingably supported with the first shaft as a support point that enables movement of the second shaft in the long hole; and at least one end of at least one of the two shafts includes a fastener via which a position of the arm is adjustable in an up-down direction.

9. The floating oceanic debris collection device according to claim 6, wherein:

the blade is structured as a flexible sheet having a convex quadrangular shape in a plan view;

the blade has two sides continuous to a predetermined side, the two sides including a long side and a short side that are different lengths; and the blade has a semi-dome shape and is fixed to the base in a state of being bent such that both ends of the long side approach each other and the long side is higher than the short side.

10. The floating oceanic debris collection device according to claim 6, wherein: the base is a donut shape having a cavity in a center; a central float is disposed in the cavity; and a position of a respective floating oceanic debris collection device of the plurality of floating oceanic debris collection devices is fixable via attaching an anchor to the central float.

11. The floating oceanic debris collection device according to claim 2, wherein:

two attachment holes are disposed in the arm, the two attachment holes including a first attachment hole and a second attachment hole;

a round hole and a long hole are disposed in the base;

the arm is pivotally supported by the base via two shafts, the two shafts including (i) a first shaft inserted into the first attachment hole of the arm and the round hole of the base and (ii) a second shaft inserted into the second attachment hole of the arm and the long hole of the base;

the arm is swingably supported with the first shaft as a support point that enables movement of the second shaft in the long hole; and at least one end of at least one of the two shafts includes a fastener via which a position of the arm is adjustable in an up-down direction.

12. The floating oceanic debris collection device according to claim 2, wherein:

the blade is structured as a flexible sheet having a convex quadrangular shape in a plan view;

the blade has two sides continuous to a predetermined side, the two sides including a long side and a short side that are different lengths; and the blade has a semi-dome shape and is fixed to the base in a state of being bent such that both ends of the long side approach each other and the long side is higher than the short side.

13. The floating oceanic debris collection device according to claim 2, wherein:

the base is a donut shape having a cavity in a center;

a central float is disposed in the cavity; and a position of the floating oceanic debris collection device is fixable via attaching an anchor to the central float.

14. The floating oceanic debris collection device according to claim 3, wherein:

the blade is structured as a flexible sheet having a convex quadrangular shape in a plan view;

the blade has two sides continuous to a predetermined side, the two sides including a long side and a short side that are different lengths; and the blade has a semi-dome shape and is fixed to the base in a state of being bent such that both ends of the long side approach each other and the long side is higher than the short side.

15. The floating oceanic debris collection device according to claim 3, wherein:

the base is a donut shape having a cavity in a center;

a central float is disposed in the cavity; and a position of the floating oceanic debris collection device is fixable via attaching an anchor to the central float.

16. The floating oceanic debris collection device according to claim 4, wherein:

the base is a donut shape having a cavity in a center;

a central float is disposed in the cavity; and a position of the floating oceanic debris collection device is fixable via attaching an anchor to the central float.

* * * * *